US005298389A

United States Patent [19]

Possanza et al.

[11] Patent Number: 5,298,389

[45] Date of Patent: Mar. 29, 1994

[54] DRY GELATIN ADDITION TO AN EMULSION/DISPERSION MIXTURE

[75] Inventors: Steven D. Possanza, Penfield; Donald E. Eaton, Walworth; Lawrence D. Meston, Rush; Edgar P. Lougheed, Byron, all of N.Y.

[73] Assignee: Eastman Kodak Company, Rochester, N.Y.

[21] Appl. No.: 952,936

[22] Filed: Sep. 29, 1992

[51] Int. Cl.[5] ..... G03C 1/015

[52] U.S. Cl. ..... 430/569; 430/631; 430/642

[58] Field of Search ..... 430/640, 642, 631, 569

[56] References Cited

U.S. PATENT DOCUMENTS

| | | | |
|---|---|---|---|
| 2,148,998 | 2/1939 | Sackett | 422/224 |
| 2,310,226 | 2/1943 | Gaspar | 430/546 |
| 2,322,027 | 6/1943 | Jelley et al. | 430/546 |
| 2,360,289 | 10/1944 | Thomas, Jr. | 430/546 |
| 2,668,764 | 2/1954 | Nauta | 426/474 |
| 2,689,794 | 1/1955 | Godowsky | 426/648 |
| 2,729,561 | 1/1956 | Marrone | 162/175 |
| 2,851,364 | 9/1958 | Peebles | 530/354 |
| 2,987,444 | 6/1961 | Allardice | 427/2 |
| 3,396,027 | 8/1968 | McFall et al. | 430/642 |
| 3,819,157 | 6/1974 | Markfelt | 366/101 |
| 4,123,174 | 10/1978 | Titus | 366/102 |
| 4,379,836 | 4/1983 | Schnoring et al. | 430/377 |
| 5,045,445 | 9/1991 | Schultz | 430/642 |
| 5,182,190 | 1/1993 | Le Faou et al. | 430/642 |

FOREIGN PATENT DOCUMENTS

| | | | |
|---|---|---|---|
| 629593 | 9/1949 | United Kingdom | 430/642 |

*Primary Examiner*—Charles L. Bowers, Jr.
*Assistant Examiner*—Mark F. Huff
*Attorney, Agent, or Firm*—Carl F. Ruoff

[57] ABSTRACT

The present invention is a method to add dry gelatin to a photographic emulsion in either a liquid or a solid form. The dry gelatin is added by entraining the dry gelatin in air to form a gaseous mixture of dry gelatin in air and directing this mixture into the solid or liquid photographic emulsion. An air eductor is used to deliver the dry gelatin. When adding dry gelatin to a solution, the rate is determined by the solution viscosity and volume. When adding the dry gelatin to a solid emulsion, the dry gelatin rate is not as critical but uniform addition is still needed to interdisperse the dry gel with the emulsion pellets.

9 Claims, 2 Drawing Sheets

DRY GELATIN ADDITION TO AN EMULSION/DISPERSION MIXTURE

FIELD OF THE INVENTION

This invention relates to a process for preparing photographic materials. More particularly, this invention relates to the production of photographic emulsions wherein the gelatin concentration is increased just prior to coating.

BACKGROUND OF THE INVENTION

In a typical emulsion/dispersion manufacturing operation, gelatin concentrations are kept low (3% to 5%) during making and finishing. The 3 to 5% gelatin concentration is the minimum level required to suspend the silver halide. Levels of gelatin above this concentration interfere with nucleation and precipitation. When the emulsion/dispersion is eventually coated a much higher viscosity is required and this is achieved by raising the gelatin concentration up to approximately 15%. Historically, the best method to raise the gelatin concentration has been to add swollen gelatin (50% gelatin) or a gelatin solution (20% to 25% gelatin) in the late stages of finishing or in melting. These methods effectively raise viscosity but also significantly dilute the silver concentration due to the water component. It has been attempted to add dry gelatin (100% gelatin) directly to gelatin based emulsion/dispersion solutions, but clumping tends to occur and the undissolved clumps add to the nonuniformity of the emulsion/dispersion. The nondissolved gelatin contributes to variability as well as filter plugging, waste, and mechanical transfer problems. Dry gelatin has a water content of approximately 10%.

The present invention solves the problem of dry gelatin addition in a novel manner. The present invention accomplishes this feat in a simple, reliable, consistent manner while avoiding the clumping problem.

SUMMARY OF THE INVENTION

The present invention comprises a method of producing a photographic emulsion for use at a coating station. A liquid solution of emulsion is prepared wherein the gelatin content in the solution is from approximately 3% to approximately 5%. Dry gelatin is then dispersed in a gaseous stream into the liquid solution by means of an eduction device so that the final gelatin content in the liquid solution is from approximately 10% to approximately 15%.

In an alternate embodiment of the present invention solid pelletized photographic emulsion having a gelatin content of approximately 3% to approximately 5% is prepared. The solid pelletized photographic emulsion is loaded into a screw blender and dry solid gelatin (100% gelatin) is dispersed into the screw blender containing the solid pelletized photographic emulsion, by means of an eduction device wherein the gelatin is mixed with the solid emulsion by the screw blender to form a homogenous mixture of the photographic emulsion.

For a better understanding of the present invention, together with other and further objects, advantages and capabilities, thereof reference is made to the following disclosure and appended claims in connection with the above described drawing.

DETAILED DESCRIPTION OF THE PREFERRED EMBODIMENTS

In the manufacture of photographic emulsions, silver nitrate is reacted with halide salts in the presence of gelatin to form photographically active silver halide emulsions. Typical photographic emulsions include silver halide, gelatin and optionally chemical addenda. Chemical addenda includes antifogging agents, stabilizers, coating additives, coupler dispersions, etc. Chemical addenda are added to provide certain properties to the photographic emulsion.

The present invention describes a process wherein dry gelatin is added to a hot gelatin based solution or photographic emulsion generally at a temperature of 90°-115° F., typically 105° F., in a consistent and uniform manner. The process is accomplished by "sucking" the dry gelatin from a hopper or container with an air eductor using regular compressed air. The air eductor delivers the dry gelatin to the surface of the solution at a constant rate. The rate is primarily determined by the solution volume in the kettle. High viscosity and poor kettle agitation will slightly reduce, by 10–25%, the optimum addition rates. Shown below is Table I listing the optimum addition rates based on kettle volume:

TABLE I

| Kettle Volume (Liters) | Addition Rate Kg/Min |
|---|---|
| 50 | 1.0 |
| 300 | 4.5 |
| 500 | 4.75 |
| 1300 | 8.0 |

The rate is of a magnitude such that each individual gelatin particle (votated) is mixed into the solution without surface clumping. If the dry gelatin is added too quickly, the individual particles partially melt and clump before they can be "wet" and dissolution of the gelatin in the liquid is then difficult.

An alternative method is to deliver the dry gel through the eductor into a blender containing a solid pelletized emulsion/dispersion mixture. With this method the rate is not as critical, but uniform addition is still needed to interdisperse the dry gelatin particles with the emulsion/dispersion pellets. The dry gelatin then absorbs water and swells prior to melting.

Figure 1:
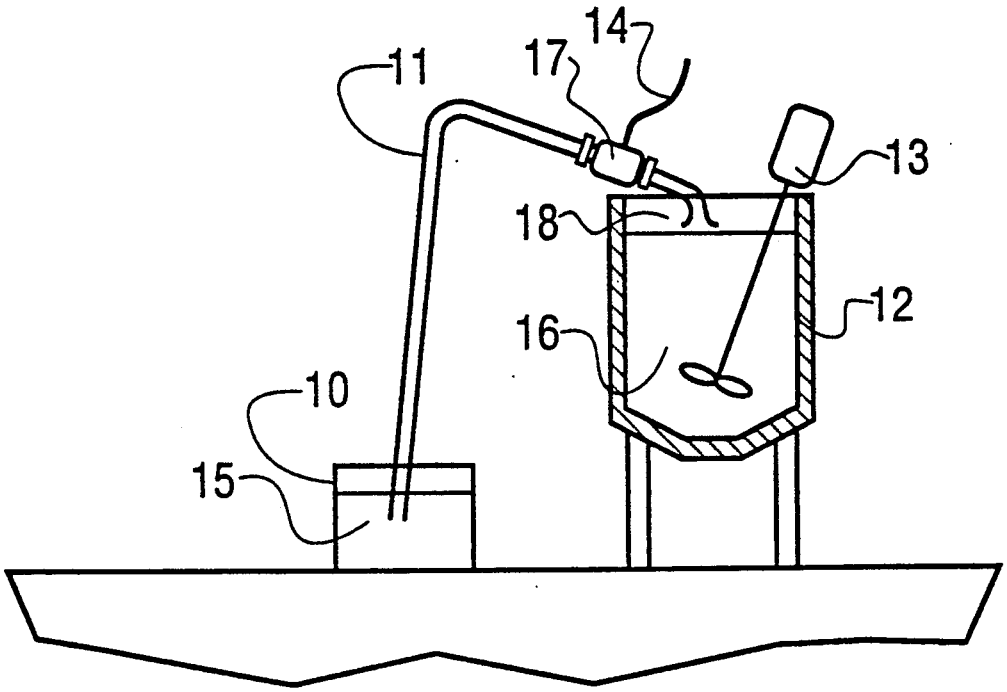
FIG. 1 shows the system used for adding dry gelatin to a photographic emulsion solution.

FIG. 1 shows a simplified apparatus for adding dry gelatin particles to a liquid emulsion/dispersion. The dry gelatin particles had an average diameter of approximately 1/16". The maximum size for gelatin particles is an average diameter of approximately ⅛". The moisture content of this pure gelatin is approximately 10%. The dry gelatin particles 15 are contained in a container 10. The gelatin particles are delivered from the container 10 to a mixing vessel 12 containing the liquid emulsion/dispersion 16. Transport tubing 11 along with an eduction device 17 using compressed air 14 is used to transport the dry gelatin particles into the mixing vessel. The liquid emulsion/dispersion is continuously mixed by mixer 13.

The dry gelatin transport system described above is designed for production scale applications delivering to a mixing vessel between 800 and 2000 liters. The optimum addition rate is dependent on the solution/mixture characteristics. A typical addition rate is 4 kilograms per minute and can vary from about 2 to about 10 kilograms per minute. A 3 to 5% solution is ideal for addition, but 10% initial solutions have been successfully used. At a temperature of 105° F., a 3% gelatin solution has a viscosity of approximately 1 cp, a 5% solution has a viscosity of approximately 4 cp, and a 10% solution has a viscosity of approximately 25 cp.

The addition rate is controlled by the specific design of the process and ultimately by adjusting the eductor and compressed air flow rate. The design is specific to the application. The compressed air is regulated between 600 and 1,000 cubic feet per hour to control dry gelatin delivery. The preferred working pressure for the compressed air is 45 psi, however, a pressure from approximately 30 psi to about 70 psi will give acceptable results. The air supply line used in the eductor had a ½" outer diameter. The process line is from about 1 inch outer diameter to about 2 inch inner diameter. The eductor gap setting is also adjusted to control delivery rate.

The addition point 18 is critical for the solution addition process and needs to be located at the point in the kettle of maximum roll. If the point of maximum roll can not be located, the addition rate must be decreased. There are two types of mixing apparatus, vortex mixers and baffle/roll mixers. Vortex mixers include a mixer in the vessel without baffles. Thus, as the rpm of mixer is increased, a vortex is formed in the kettle. For vortex mixing, the addition point is at the center of the vortex, i.e. the maximum roll. In the preferred method, the rpm of the mixer is increased to the point where the vortex "sucks" air on the surface. The dry gelatin is then added directly to this point.

With baffle/roll mixing, no vortexing occurs (due to the baffles) and the dry gel is added at the point where the surface roll turns under the solution. This is determined visually. The addition point is kept away from the baffles. The optimum addition point is somewhat subjective but is readily determined by someone skilled in the art. In addition, each system differs depending on the kettle size and shape, the mixer type, the mixer speed, the number and placement of baffles and the solution viscosity.

The following examples demonstrate the utility and feasibility of the present invention. Table II shows the initial solution volume, initial gelatin concentration for three examples. The gelatin concentration was raised by 4–6% in each example. The eduction device used was a PIAB Ejector 300 available from Hughes Industrial Products. The gelatin addition rate and total amount added are also provided

TABLE II

| Solution Volume in Kettle [l] | Initial Gelatin Concentration [%] | Approximate Viscosity [cp] Initial | Approximate Viscosity [cp] Final | Addition Rate of Dry Gel [kg/min] | Total Gelatin Amount Added [kg] | Final Gelatin Concentration [%] |
|---|---|---|---|---|---|---|
| 300 | 8 | 18 | 30 | 4.5 | 13 | 12 |
| 500 | 8 | 18 | 30 | 4.75 | 24 | 12 |
| 50 | 3 | 1 | 20 | 1.0 | 5 | 9 |

Figure 2:
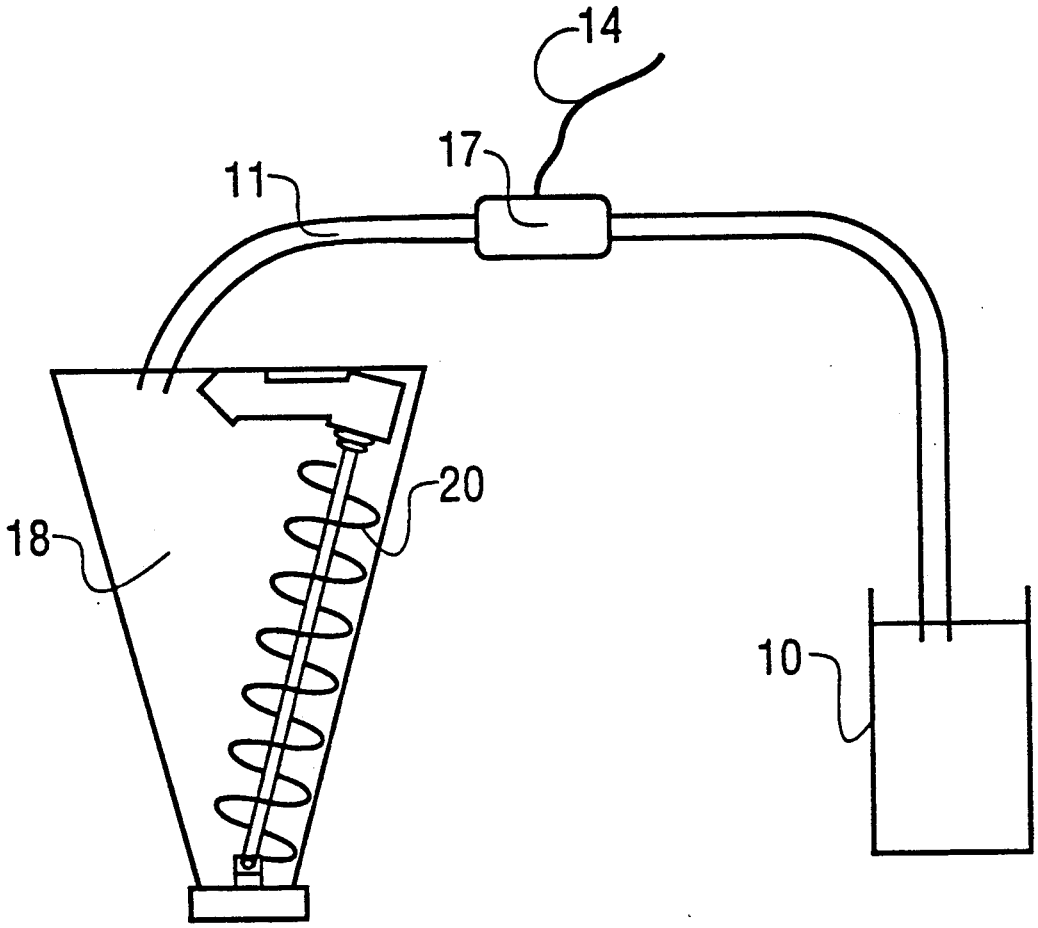
FIG. 2 shows an alternate system used for adding dry gelatin to a solid mixture.

FIG. 2 shows the system used for adding dry gelatin to a photographic emulsion, i.e. a solidified gelatin solution at 45° F. Dry gelatin is stored in container 10 and is transported to the solid blending device 20 by means of the eduction device 17. The eduction device includes a tube 11 and an input for compressed air 14.

The eduction device 17 (PIAB Ejector 300) transports the dry gelatin to a point 18 within the solid blender 20. As the dry gelatin having an average diameter of ⅛" is added to and mixed with the solid material, the dry gelatin is uniformly blended throughout the mixture of the photographic emulsion. As it contacts the photographic emulsion, the dry gelatin absorbs water and swells. The result is a homogeneous, easily melted, solid material.

The location of the addition point 18 can be anywhere within a circle of ½ the radius of the mixing vessel, assuming the mixing vessel is circular. The solid blending device 20 is a conical screw blender available form Day Mixing of Cincinnati. For the system shown in FIG. 2, the flow rate of the dry gel is approximately 4–8 kg/min using a 5000 liter blender and 1–2 kg/min for a 100 liter lab scale blender.

Table III shows two samples that were run successfully using the configuration shown in FIG. 2. Table 2 shows the solution volume, initial gelatin concentration, dry gelatin addition rate, total amount of gelatin added and the final gelatin concentration. A Day Mark II was used as the conical screw blender with the orbiting screw rotating at about 1–2 rpm.

TABLE III

| Solution Volume in Kettle [l] | Initial Gelatin Concentration [%] | Addition Rate of Dry Gel [kg/min] | Total Gelatin Amount Added [kg] | Final Gelatin Concentration [%] |
|---|---|---|---|---|
| 100 | 7 | 2 | 7 | 13 |
| 5000 | 7 | 4.5 | 81 | 8 |

While there has been shown and described what are at present considered the preferred embodiments of the invention, it will be obvious that those skilled in the art various alterations and modifications may be made without departing from the scope of the invention.

What is claimed:

1. A method of producing a photographic emulsion comprising a mixture of gelatin, silver halide and optionally chemical addenda for use at a coating station comprising:

preparing a liquid solution of emulsion wherein the gelatin content in the solution is from approximately 3% to approximately 5%; and dispersing dry gelatin into the liquid solution by entraining dry gelatin having an average diameter of less than ⅛ of an inch in a gaseous stream and directing said stream into said solution until the final gelatin content in the liquid solution is from approximately 10% to about 15%.

2. The method according to claim 1 wherein the method of preparing the liquid solution of emulsion comprises:

mixing a plurality of components selected from the group consisting of silver halide emulsions, dispersions, chemical addenda, gelatin and water.

3. The method according to claim 2 further comprising:

solidifying said plurality of components by chilling;

storing said solidified components; and melting said solidified components to form the liquid solution of emulsion.

4. The method according to claim 1 wherein said dispersing dry gelatin into the liquid solution by entraining dry gelatin in a gaseous stream is accomplished by an eduction device.

5. A method of preparing a photographic emulsion comprising a mixture of gelatin, silver halide and optionally chemical addenda for use at a coating station comprising:

preparing a solid pelletized photographic emulsion having a gelatin content of approximately 3% to approximately 5%;

loading the solid pelletized photographic emulsion into a screw blender;

dispersing solid gelatin into the screw blender by entraining dry gelatin in a gaseous stream and directing said stream into the screw blender so that the gelatin is mixed with the solid emulsion by the screw blender to form a homogeneous mixture of photographic emulsion.

6. The method according to claim 5 further comprising:

melting the homogeneous mixture of photographic emulsion prior to feeding the emulsion to a coating station.

7. The method according to claim 5 wherein the method of preparing a solid pelletized photographic emulsion comprises:

mixing a plurality of compounds selected from the group consisting of silver halide emulsions, dispersions, chemical addenda, gelatin and water.

8. The method of claim 7 further comprising:

solidifying said plurality of components by chilling; and pelletizing said solidified components.

9. The method according to claim 5 wherein said dispersing solid gelatin into the screw blender by entraining dry gelatin in a gaseous stream is accomplished by an eduction device.

* * * * *